United States Patent [19]

Lawrence

[11] 3,946,916

[45] Mar. 30, 1976

[54] PACK FRAME LENGTH ADJUSTING COUPLING

[75] Inventor: John S. Lawrence, Ogden, Utah

[73] Assignee: Browning Arms Company, Morgan, Utah

[22] Filed: Feb. 14, 1974

[21] Appl. No.: 442,488

[52] U.S. Cl. ..... 224/25 A; 403/292

[51] Int. Cl.[2] ..... A45F 3/10

[58] Field of Search..... 224/25 A, 8 R; 403/292, 403/306

[56] References Cited

UNITED STATES PATENTS

| | | | |
|---|---|---|---|
| 2,759,239 | 8/1956 | Snyder | 403/292 X |
| 3,581,961 | 6/1971 | Owens | 224/25 A |
| 3,827,612 | 8/1974 | Mead et al. | 224/25 A |

FOREIGN PATENTS OR APPLICATIONS

| | | | |
|---|---|---|---|
| 568,359 | 1/1933 | Germany | 224/25 A |

*Primary Examiner*—Robert J. Spar
*Assistant Examiner*—Jerold M. Forsberg
*Attorney, Agent, or Firm*—Trask & Britt

[57] ABSTRACT

A coupling, normally of tubular construction, is adapted at one end for connection to the lower end of the side supports of a pack frame. The other, or second, end of the coupling is adapted for connection to hip-belt attachment means. The shoulder-to-hip length of the pack frame may be adjusted by selectively varying the distance between the second end and the point of connection of the coupling to the side support members of the frame.

4 Claims, 4 Drawing Figures

PACK FRAME LENGTH ADJUSTING COUPLING

BACKGROUND OF THE INVENTION

1. Field

This invention pertains to backpacks and provides a coupling useful for adjusting the shoulder-to-hip length of such a frame.

2. State of the Art

Many common backpack frames of today have upstanding, spaced apart, side support members with structural means for holding the support members in their spaced apart condition. The side support members are approximately parallel and are inherently oriented approximately vertical when the frame is strapped to the back of an individual. In certain frames, the side support members are not quite parallel and may be somewhat closer spaced at either the upper or lower end of the frame. In any event, means are provided for attaching shoulder straps to the frame so that one strap may be brought over each shoulder of the user. Characteristically, one end of each strap is connected at a point above the midpoint of the frame and the other ends of the straps are connected to the frame below its midpoint, usually near its lower end.

Modern pack frames generally include a hip-belt or hip-strap arrangement whereby a portion of the load may be carried suspended from the hips. Such a hip-belt is usually connected to the frame either directly or by bracket means secured to the frame near the bottom of the frame.

Backpack frames are generally available in several sizes to provide a selection of frames for different body dimensions. Whatever the size of a particular frame, it is fixed in dimension with respect to both its width and vertical height. Selection of a properly sized frame is important because the frame, to be comfortable in use, must be dimensioned in correspondence to the distance between the shoulders and hips of the user.

A properly sized frame, when correctly affixed to the back of the user in general cervical alignment, should not extend so low that it interferes with the user's legs or positions the hip-belt below the user's hips. At the same time, it must not be so short as to place the hip-belt above the waist area and thus reduce the hip-belt's effectiveness. Shoulder straps which are used to suspend the frame on the back of the user are typically adjustable in length to allow for different shoulder-to-hip dimensions. However, only limited length adjustment of the shoulder straps is possible within the "comfort range" of the user. Straps of either too short or too great length are awkward and unpleasant in use. If the shoulder straps are adjusted to within the comfort range, the hip-belt will inherently be brought to an inappropriate level for users having longer or shorter torsos that those which match the frame. Of course, the torso length appropriate for a frame is also dependent on the girth of the user. There is thus a need for a simple device capable of providing for selective adjustment of the shoulder-to-hip dimensions of a backpack to accommodate users of different torso and girth dimensions.

SUMMARY OF THE INVENTION

The present invention comprises a coupling with a first element adapted for slideable engagement with the lower end of a side support member of a pack frame and a second element, normally an extension of the first element, adapted to carry hip-belt attachment means. The first and second elements of the coupling may in certain embodiments comprise opposite ends of a short section of conduit, each end being provided with suitable connector or fastening means for connection to the frame and hip-belt attachment means. Usually the side support members of the pack frame are constructed of conduit or similar tubing and are substantially circular in cross-section. Of course, it is recognized that in certain instances the structural members of a pack frame may have some other convenient geometric configuration, but for purposes of this disclosure the frame and the coupling will be regarded as having circular cross-sections and as being constructed of conduit of aluminum and/or magnesium alloy material.

A suitable slideable engagement coupling is of the male-female type wherein the first element of the coupling member is of either reduced or expanded diameter to form a convenient male or female portion of the engagement. The second element is configurated to adapt to a hip-belt bracket structure which may require either a different size or shape perimeter.

For purposes of this disclosure, the shoulder-to-hip length of a frame may be regarded as the distance measured between a plane intersecting the uppermost portions of the shoulder straps as they pass over the shoulders of the user and a parallel plane intersecting the hip-belt when it is oriented approximately normal the side support members. It is recognized that the side support members may be curved or otherwise configurated so that precise location of a plane is not practical. No great precision is required in determining the exact shoulder-to-hip length because only relative adjustment of this length is important from the standpoint of this invention. Accordingly, the first plane or shoulder plane and the second plane or hip plane may be oriented in a more or less arbitrary fashion provided they are parallel so that shortening or lengthening of the distance between them may be visualized.

According to this invention, adjustment of the shoulder-to-hip length of a pack frame is accomplished by adjusting the distance between the point of attachment of the first element to the side support member of the pack frame and the point of attachment of the second element of the coupling to the hip-belt attachment means. Such adjustment may be accomplished by varying the degree of insertion of the male portion of the engagement connection at either or both ends of the coupling.

BRIEF DESCRIPTION OF THE DRAWINGS

In the drawings, which illustrate what is presently regarded as the best mode for carrying out the invention.

DESCRIPTION OF THE ILLUSTRATED EMBODIMENT

Figure 1:
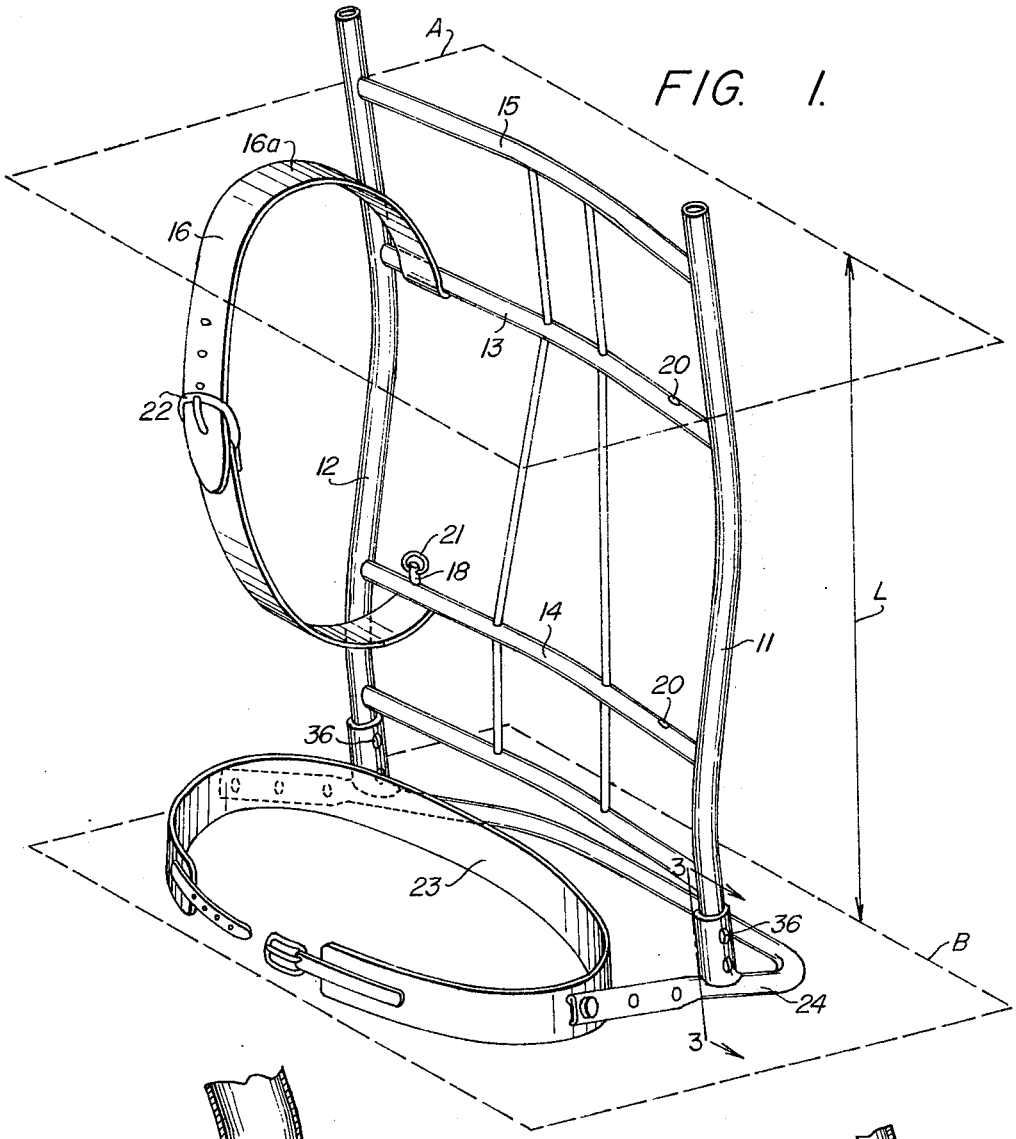
FIG. 1 is a view in perspective of a conventional backpack frame carrying a hip-belt attachment bracket.

As shown by FIG. 1, a conventional backpack frame includes side support members 11, 12 formed of round cylindrical tubing and horizontal support members 13, 14, 15 which constitute means for holding the side support members 11, 12 spaced apart. Shoulder straps 16 are connected to the horizontal support members 13, 14 to provide a means for securing the backpack frame to the back of its user in general cervical alignment. Only the right shoulder strap 16 is depicted in FIG. 1, for the sake of clarity. The shoulder straps 16 may be secured to the frame in any convenient fashion, such as by pins 18 secured through bores 20 by split rings 21 as shown. The shoulder straps 16 may be adjusted in length by buckles 22 which act as adjustment means to allow the user to selectively adjust the fit of the frame to his back. A hip-belt 23 is carried by a bracket 24 fixed to the supports 11, 12. A shoulder plane A may be regarded as passing through the uppermost portion 16a of the straps 16 and a second plane B may be regarded as passing through hip-belt 23 substantially parallel to plane A. The distance L between these planes is the shoulder-to-hip length of the frame.

Figure 2:
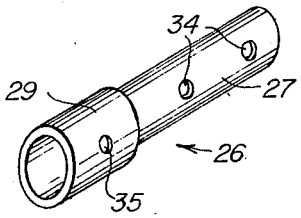
FIG. 2 is a perspective view of a preferred form of the invention.
Figure 4:
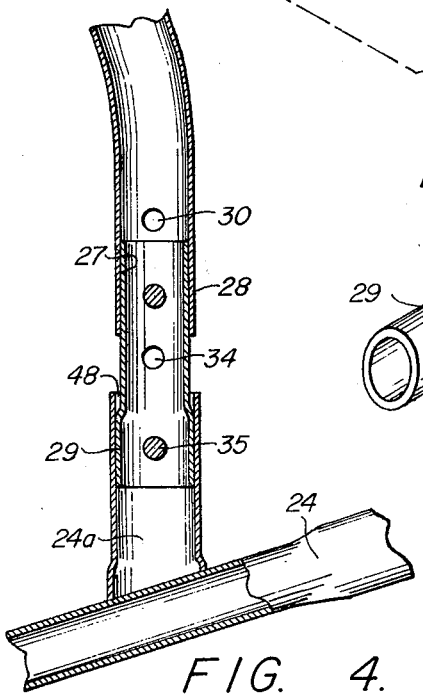
FIGS. 3 and 4 are fragmentary views in section of portions of the frame and bracket structures of FIG. 1 showing the use of the invention.

Referring to FIG. 2, the illustrated couplings 26 of this invention include a first element 27 (or shank portion) configurated to engage the bottom end 28 of one of the side support members 11, 12 of the frame. A plurality of spaced apart bores 30 may be provided in the support member 11, and one or more matching spaced apart bores 34 are provided in the coupling to register selectively with the bores 30 as illustrated by FIGS. 3 and 4, thereby selectively adjusting the distance L between the planes A and B.

The second element 29 of the coupling 26 is an enlarged end configurated in cross-section approximately the same as the ends 28 so that the bracket 24 may be engaged by the elements 29 in the same fashion as the supports 11, 12. The element 29 is provided with a bore 35 which may be brought in registration with a corresponding bore 36 in the bracket 24. The elements 27, 29 of the coupling 26 may be secured to the frame and bracket, respectively, by pins through the registered bores. The distance L is progressively greater as illustrated by FIGS. 1, 3 and 4, respectively.

To utilize the invention, the user need only select the appropriate adjustment best suited to his own shoulder-to-hip dimension.

Figure 3:
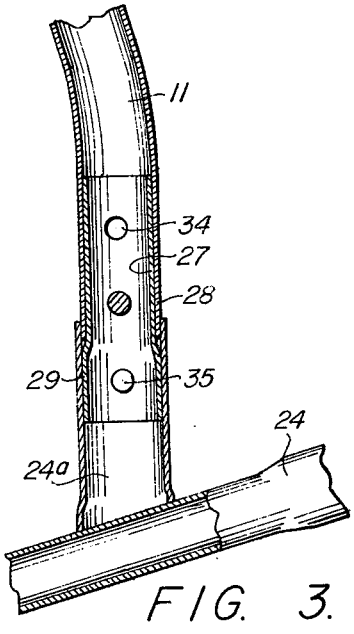

As best illustrated in FIG. 3, the second element 29 is tubular and sized to slideably engage an upstanding tubular extension **24*a* of the bracket 24. The diameters of the element 27 and extension 24*a* are such that a small gap 48 is formed circumferentially around the coupling 26 between the inside surface of the extension 24*a* and the outer surface of the first element 27 of the coupling 26. The bottom end 28 of the side support 11 may be received by the space 48 as shown in FIG. 3. Although not essential to the invention, this feature permits an increased range of adjustment while providing for good stability to the hip-belt attachment means 24.**

The foregoing description is for purposes of illustration only and is not intended to limit the scope of the invention, those features regarded as critical to the invention being recited in the appended claims.

I claim:

1. A backframe structure comprising:

a back frame carrying shoulder straps and including a pair of side support members with bottom ends formed of tubular construction;

a hip belt frame carrying a hip belt and including a pair of upstanding tubular members corresponding to said side support members and of sufficiently large cross-section to receive said bottom ends of said side support members;

a pair of coupling members, each with an enlarged end mounted within a said upstanding tubular member and a shank portion of smaller cross-section extending up in slideable engagement within the interior of the bottom end of the corresponding said side support member, said enlarged ends being inserted sufficiently within said upstanding tubular members to provide an annular gap between the internal surface of said tubular members and the shanks of said coupling members, said gap to receive the bottom ends of said support members when said shanks are inserted to the maximum extent within said bottom ends;

means for connecting said enlarged end portions to said tubular members; and means for connecting said shank portions to said side support members.

2. The improvement of claim 1 wherein said support members are constructed of hollow conduit and said shank portions of said couplings are of hollow conduit having cross-sectional configuration similar to that of said side support members but sized for slideable, male-female engagement with said support members.

3. The improvement of claim 2 wherein said enlarged end portions of said couplings are constructed of hollow conduit having cross-sectional perimeters configurated approximately identical to that of said side support members.

4. The structure of claim 1 including means for connecting said shanks of said coupling members to said bottom ends of said side support members at selected engagement positions.

* * * * *